US006715477B1

(12) United States Patent
Gilman

(10) Patent No.: US 6,715,477 B1
(45) Date of Patent: Apr. 6, 2004

(54) METHOD AND APPARATUS FOR EMULATING THE KICKING OF AN OBJECT

(75) Inventor: Neil F. Gilman, Glastonbury, CT (US)

(73) Assignee: Marty Gilman, Inc., Gilman, CT (US)

( * ) Notice: Subject to any disclaimer, the term of this patent is extended or adjusted under 35 U.S.C. 154(b) by 0 days.

(21) Appl. No.: 10/317,881

(22) Filed: Dec. 12, 2002

(51) Int. Cl.[7] ..... F41B 7/00

(52) U.S. Cl. ..... 124/16; 124/17; 124/36; 124/79; 473/438; 434/251

(58) Field of Search ..... 124/16, 17, 20.1, 124/36, 79; 434/247, 251, 256; 473/438, 439, 441

(56) References Cited

U.S. PATENT DOCUMENTS 2,193,441 A * 3/1940 Batkin ..... 473/511
3,399,892 A * 9/1968 Jurkiewicz ..... 473/438
3,942,796 A * 3/1976 Bowen ..... 473/441
4,122,822 A * 10/1978 Scheiwiller ..... 124/54
4,282,848 A * 8/1981 Kulesza et al. ..... 124/16
4,906,001 A * 3/1990 Vaughn ..... 473/438
4,995,371 A * 2/1991 Kuizinas ..... 124/7
5,224,701 A * 7/1993 Sciarrillo et al. ..... 124/73
5,415,150 A * 5/1995 Dallas ..... 124/50
5,465,978 A * 11/1995 Magnone et al. ..... 124/7
5,619,977 A * 4/1997 Gatin ..... 124/7
5,911,214 A * 6/1999 Andrews ..... 124/16
6,050,906 A * 4/2000 Stout et al. ..... 473/438
6,089,215 A * 7/2000 Morris et al. ..... 124/16
6,280,285 B1 * 8/2001 Morehouse ..... 446/333

* cited by examiner

*Primary Examiner*—Kien T. Nguyen
(74) *Attorney, Agent, or Firm*—Kudirka & Jobse, LLP

(57) ABSTRACT

An apparatus that simulates punting and place kicking of a ball includes a prosthetic leg having a mechanism in the foot region to seat a ball. The leg is pivotally-mounted to a frame and mechanically coupled with a foot pedal. Downward force on the foot pedal is translated to the leg causing the leg to whip upward and launching the ball with proportional force and speed. In one embodiment, the frame is collapsible/expandable and includes a roller to facilitate transportation. In another embodiment, the leg is formed of pliable material to eliminate the risk of injury in the event of collision therewith.

26 Claims, 5 Drawing Sheets

METHOD AND APPARATUS FOR EMULATING THE KICKING OF AN OBJECT

FIELD OF THE INVENTION

The present invention relates in general to athletic training equipment, and, more particularly, to an apparatus that imitates the kicking of a ball by a player.

BACKGROUND OF THE INVENTION

In football, rugby and soccer, as well as other sporting or athletic contests which utilize a ball, kicking or punting the ball is often part of the game. In football, the player punting the ball is often rushed by the opposing team in an attempt to block the punt and, therefore, prevent the ball from moving down field. There has not been a practical manner in which to practice blocking of a punt without running at full speed towards an actual kicker. Unfortunately, this can lead to injury of both the blocking and the punting player.

Apparatus exists for pitching or throwing footballs and baseballs such as the Football Passing Machine commercially-available from the Jugs Company, Tualatin, Oreg. 97062. Such apparatus consists of one or more motor-driven wheels. The ball is dropped into contact with the rotating wheels and is accelerated into a trajectory depending on the angular orientation of the rotating wheels and the speed thereof. Although such devices can simulate the trajectory of a punt, it is not advisable to run full speed towards such a device without the risk of injury.

According, a need exists for an apparatus which enables players to practice punt blocking and which reduces the likelihood of injury to one or more players.

A further need exists for an apparatus in which the kicking or whipping motion of a leg during a punt exercise is mimicked and which can create a realistic trajectory for the ball.

A further need exists for an apparatus in which the element and launching the ball has the same shape and rigidity of a human appendage.

A further need exists for an apparatus which is capable of imitating the motion of a leg in the process of kicking a ball and which can be controlled so as to simulate different kicking techniques.

SUMMARY OF THE INVENTION

The present invention provides an apparatus that simulates punting and place kicking. The apparatus comprises a pair of upright posts secured to an expandable frame. An elongate member, such as a prosthetic leg having a cradle at the foot region thereof, is pivotally mounted intermediate the set of posts. The leg is mechanically coupled via a cable or other mechanism to a foot pedal that is mounted to another of these posts. When force is delivered to the foot petal, the leg whips up with the same velocity of a kicker swinging through a kicking motion. When the leg is whipped, the ball flies off the foot cradle and into the air imitating the trajectory of a kick. A blocker can get a full extension during approach and dive at the block point in an effort to take the ball off the leg. The leg is preferably made from a pliable material such as molded rubber to eliminate the risk of injury, should a collision occur between the blocker and the leg. In one embodiment, the frame is padded and may be extended and collapsed for ease of transportation.

According to a first aspect of the invention, an apparatus for launching a ball comprises: (a) a rigid frame; (b) an elongate first member movably mounted to the frame; (c) the first member having a first end thereof shaped to receive an object; (d) a second member mounted to the frame; (e) means for mechanically coupling the first member to the second member so that force is transferable from the second member to the first member; and (f) the first member pivotal relative to the frame upon receipt of force transferred to the first member from the second member so that an object received at the first end of the first member is launched. In one embodiment, the second member is pivotally mounted to the frame and further comprises a first end shaped to receive force applied to the second member. In another embodiment, the first member and second members each have a second end coupled to the means for mechanically coupling and wherein the means for mechanically coupling the first member to the second member comprises a cable.

According to a first aspect of the invention, an apparatus for imitating kicking of an object comprises: (a) a rigid frame; (b) a first projection extending outward from the frame; (c) a first member movably mounted to the first projection; (d) a mechanism at a first end of the first member shaped to receive and retain an object therein; (e) a second member mounted to the frame; (f) means for mechanically coupling the first member and the second member; and (g) the first member pivotal relative to the first projection so that an object retained in the indentation at the first end of the first member is launched upon receipt of force transferred to the first member from the second member.

According to a third aspect of the invention, an apparatus for launching a ball comprises (a) a rigid frame (b) a prosthetic leg movably mounted to the frame; (c) the prosthetic leg shaped to seat a ball therein; (c) a pedal pivotally mounted to the frame; (d) a cable coupling the prosthetic leg to the pedal so that force applied to the pedal is transferable to the prosthetic leg; and (e) the prosthetic leg pivotal relative to the frame so that a ball seated in the indentation of the prosthetic leg is launched upon receipt of force by the pedal. According to a sixth aspect of the invention, the rigid frame comprises a pair of telescoping members that are collapsible to facilitate the movement of the unit. In one embodiment, the rigid frame comprises members that are collapsible to facilitate the movement of the apparatus.

According to a fourth aspect of the invention, a method for imitating the launching of an object comprises: (a) providing an apparatus having a frame with first and second members movably mounted to the frame, the first and second members mechanically coupled, the first member having a first end and shaped to receive an object; (b) placing an object into the first end of the first member; and (c) applying force to the second member so that the force is transferred to the first member causing the first member to pivot relative to the frame and further causing the object to disengage the first member.

According to a fifth aspect of the invention, a method for facilitating controlled launching of an object comprises: (a) providing a rigid frame; (b) movably mounting a first member to the frame, the first member having a first end shaped to receive an object; (c) movably mounting a second member to the frame; (d) mechanically coupling the first member to the second member so that force can be transmitted from the second member to the first member causing the first member to pivot relative to the frame so that an object received at the first end of the first member will be launched from the first member.

BRIEF DESCRIPTION OF THE DRAWINGS

The above and further advantages of the invention may be better understood by referring to the following description in conjunction with the accompanying drawings in which.

DETAILED DESCRIPTION

Figure 1:
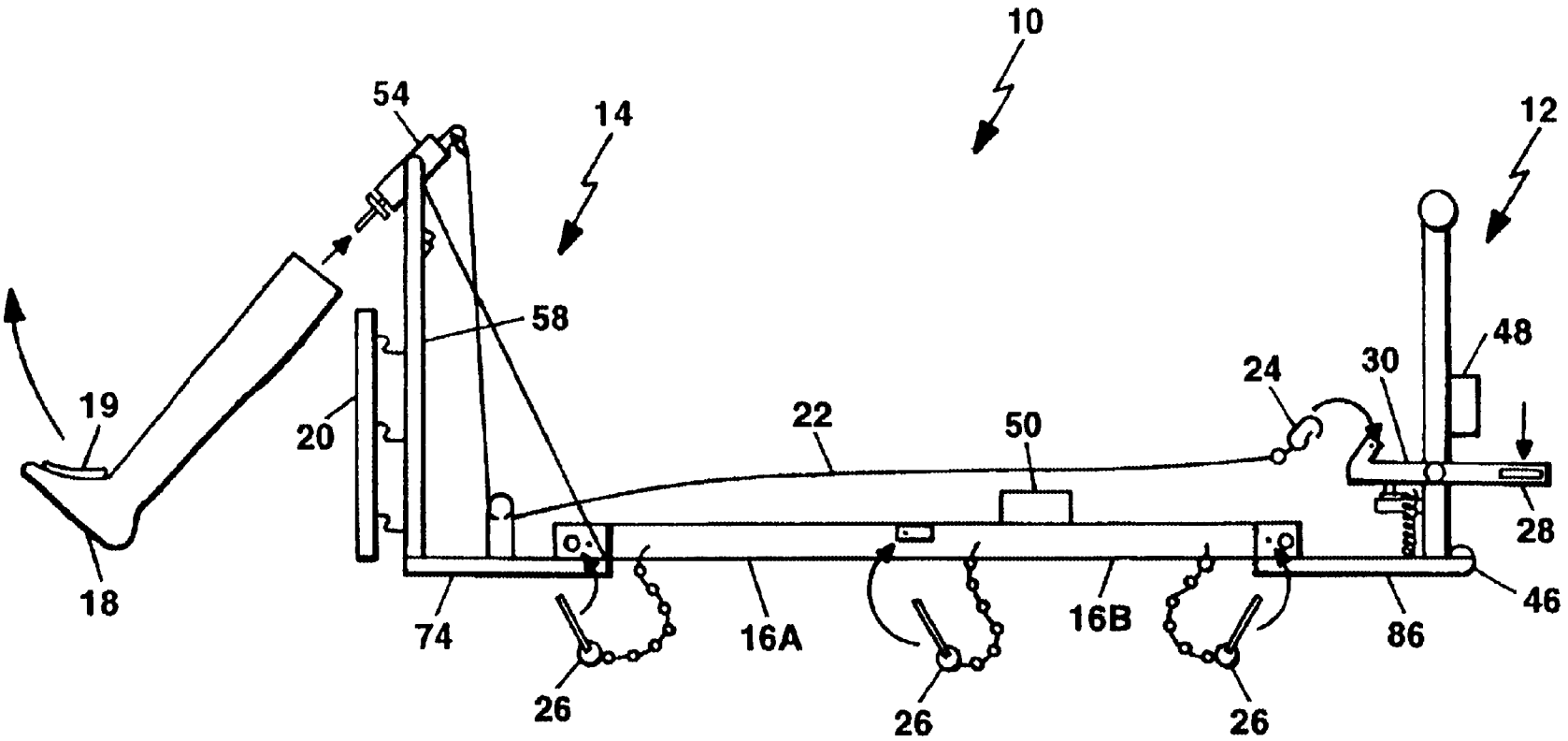
FIG. 1 is a partially assembled side view of the kick blocking apparatus in the present invention.
Figure 2A:
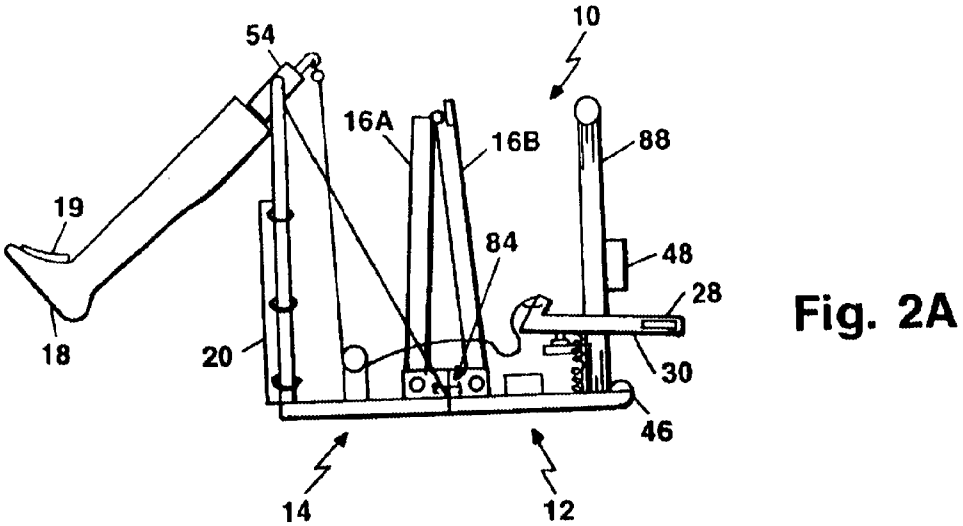
FIGS. 2A–B are side plan views of the apparatus of FIG. 1 showing, collapsed, partially extended and fully extended positions.
Figure 2B:
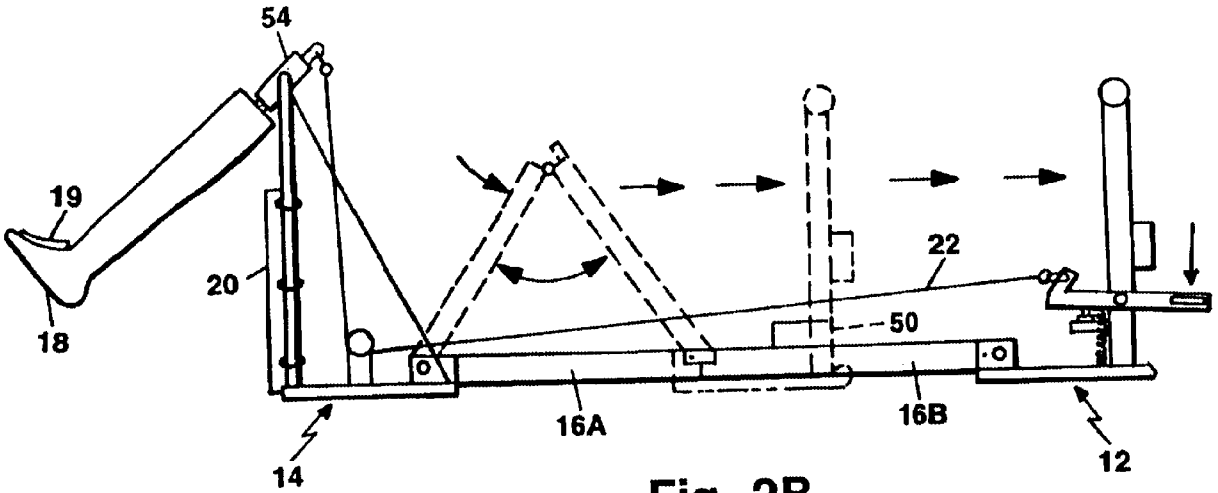

Referring to FIGS. 1–2B, a punting and place kicking simulation apparatus 10 in accordance with an illustrative embodiment of the present invention comprises an operator's station assembly 12 and a leg swing assembly 14 mechanically coupled by a collapsible/expandable bridge 16 which collectively form a rigid frame. An elongate member, implemented in the illustrative embodiment as a pliable prosthetic leg 18, is pivotally mounted to the leg swing assembly 14. A pedal 28 and pedal arm 30 are mounted to the operator's station assembly 12, as illustrated. A cable 22 operatively couples pedal arm 30 and leg mount assembly 54 via a pulley 52 attached to the leg swing assembly 14. A resistance mechanism, implemented in the illustrative embodiment as spring 56, secures pedal arm 30 to operator's station assembly 12. A plurality of locking pins 26A–C enable bridge sections 16A and 16B to be locked into a rigid position between leg swing assembly 14 and operator station 12. Leg 18 is secured to leg mount assembly 54 which is, in turn, mounted to a pair of leg swing posts 58. A pad 20 may be removably secured to the leg swing posts 58. An opening handle 48 mounted to the operator station assembly 12 facilitates expanding of the collapsible bridge 16 while a closing handle 50 mounted to bridge 16 facilitates collapsing thereof. A mechanism on the foot portion of the prosthetic leg 18 is sized and shaped to accommodate the circumference of the ball to be launched, e.g. a football, rugby ball, soccer ball, etc. Once assembled, and with a ball situated at the free end of prosthetic leg 18, a downward force delivered to foot pedal 28 will cause the pedal arm 30 to pivot relative to the t-handle post 62 of operator's station assembly 12 causing the force exerted on the pedal to be transmitted through cable 22 to leg assembly mount 54 and leg 18 which then pivots upward relative to leg swing posts 58 causing the ball to be launched with a trajectory substantially in proportion with the amount of force delivered to foot pedal 28. An optional roller 46 may be pivotally secured to an edge of operator's station assembly 12 to facilitate ease of transportation of the apparatus 10 when in a collapsed position.

Figure 3:
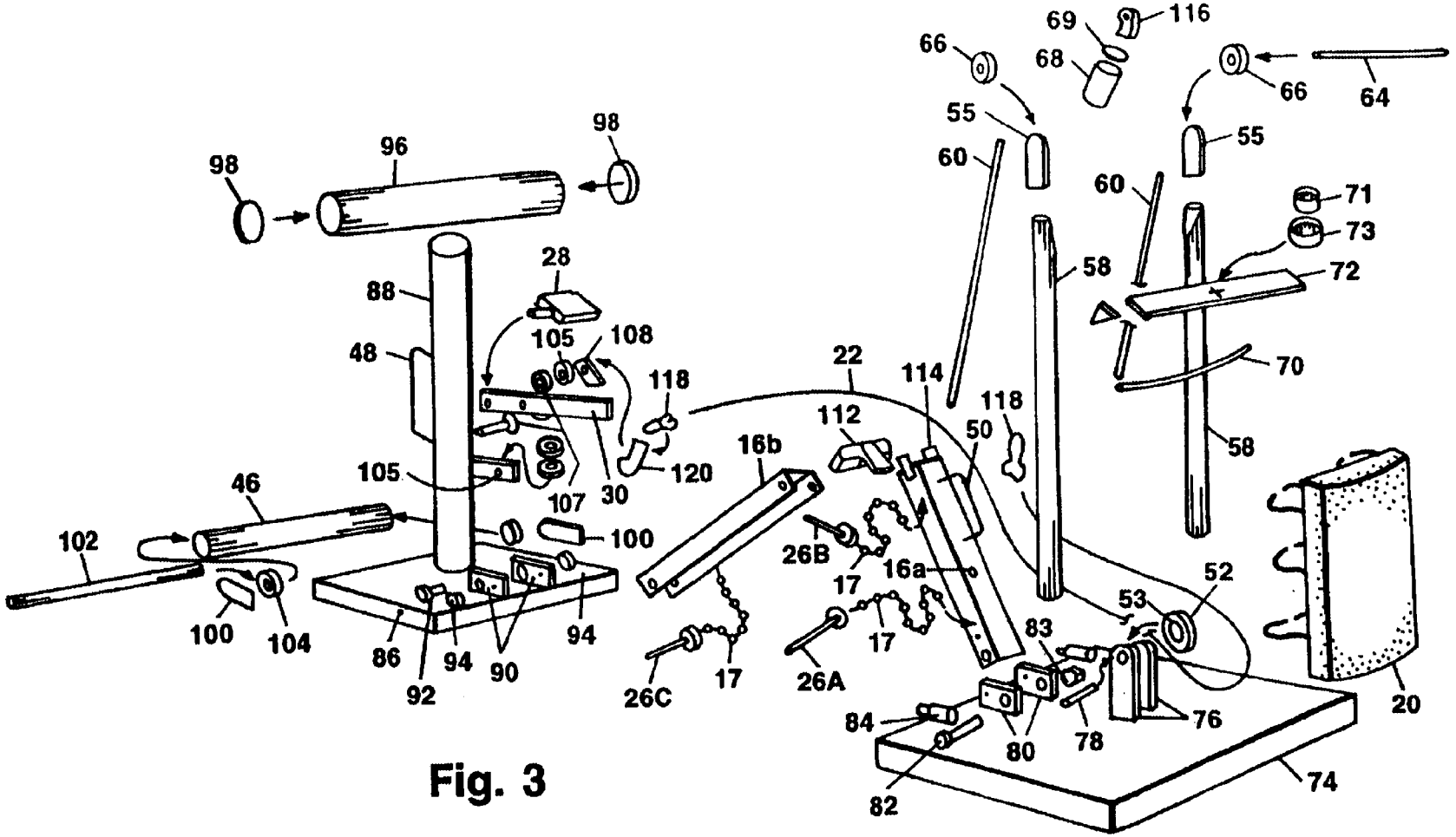
FIG. 3 is an exploded view of the kick blocking apparatus of FIG. 1.
Figure 4:
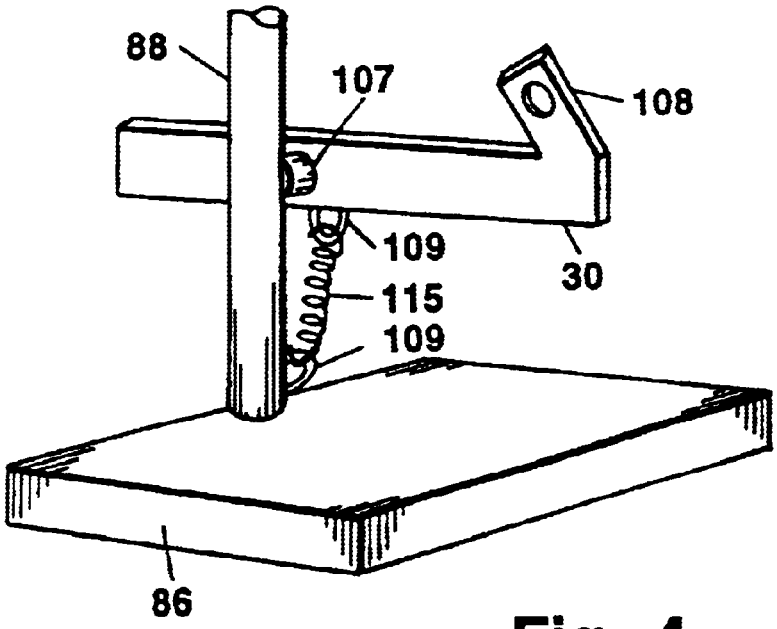
FIG. 4 is a partial perspective view of the operator's station assembly of the present invention.
Figure 5:
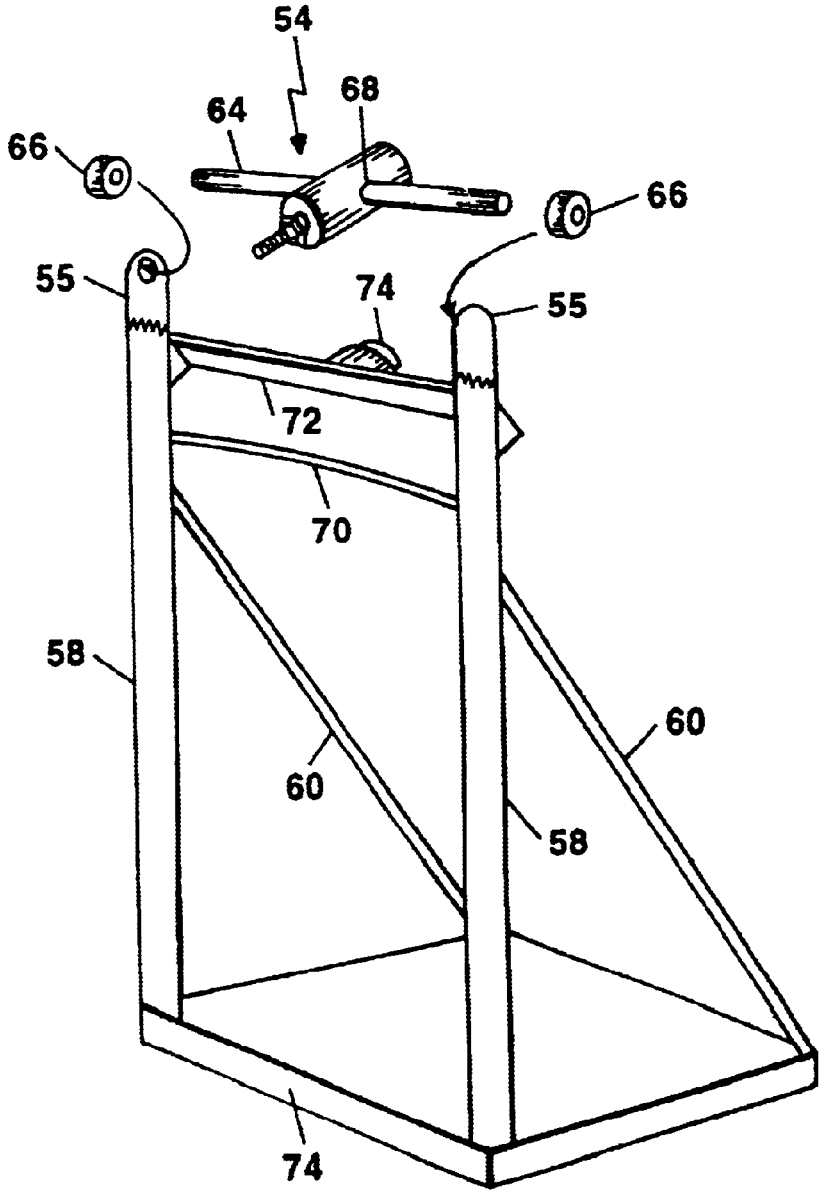
FIG. 5 is a partially exploded view of the leg swing assembly of the present invention.

FIG. 2A illustrates the apparatus 10 similar to that illustrated in FIG. 1 except that bridge 16 is shown in a collapsed position to facilitate transportation of apparatus 10. FIG. 2B illustrates the same apparatus as FIG. 2A, in an intermediate position, as shown, in phantom, as the bridge members 16A–B begin to expand when operator's station assembly 12 is pulled in the direction of the arrow relative to the leg swing assembly 14 until the bridge 16 is fully extended, as illustrated. FIGS. 3–5 disclose the various components of the operator's station assembly 12, leg swing assembly 14 and bridge 16 in greater detail. Unless noted otherwise herein, all components described herein may be made from steel or other materials having similar rigidity. FIG. 3 illustrates an exploded view of assemblies 12, 14 and 16 and the components thereof.

Referring to FIGS. 3 and 5, leg swing assembly 14 comprises a base 74 to which a pair of elongate leg swing posts 58 are mounted, typically by welding, to project upward from base 74. Posts 58 have a pair of leg bearing mounts 55 attached, typically by welding, to the free ends of posts 58. A pair of vertical cross braces 60 are secured, again by welding, to each of leg swing posts 58 and base 74, as illustrated, to provide support for the leg swing posts 58. The free ends of mounts 55 have accept leg axle 64 which is journalled therebetween with a pair of leg bearing 66. Axle 64 carries leg mount assembly 54 which may comprise, in the illustrative embodiment, a leg mount cylinder 68 having a pair of O-shaped end caps 69 welded thereto and a bolt protruding therefrom onto which leg 18 may be secured with a complimentary mating thread. Leg swing assembly 14 further comprises a cross brace 70 secured between leg swing posts 58 and a cross plate 72 which is secured intermediate leg swing posts 58 at an angle. A rubber stop 71 and collar 73 may be secured about the mid-section of cross plate 72 to prevent leg mount cylinder 68 from striking cross plate 72 when leg 18 is fully extended.

A protective pad 20, is secured between leg swing posts 58 of leg swing assembly 14 to protect an on-rushing blocker from striking the leg swing posts 58, particularly during a diving block maneuver. In the illustrative embodiment, protective pad 20 may comprise a soft material such as urethane or polyurethane foam covered with a vinyl jacket and securable to leg swing posts 58 through any number of conventional means such as snaps, straps, ties, velcro tabs, etc., to allow for either permanent or temporary placement thereon. As shown in FIG. 3, base 74 of leg swing assembly 14 has affixed thereto, typically by welding, a pair of pulley-mount bracket 76, each having a hole at the free end thereof. A pulley 52 having an internal bearing on an interior diameter thereof is carried by a pulley axle 78 which is journaled into the pulley-mount brackets 76. The exterior diameter of pulley 52 is grooved to receive cable 22, as explained hereinafter. A pair of hinge brackets 80 are mounted, typically through welding, to the upward facing surface of base 74 of leg swing assembly 14. Hinge brackets 80 are spaced apart an amount adequate to allow section 16B of bridge 16 to be secured therebetween with a hinge bolt 82 and nut. In addition, base 74 has attached thereto a locking mechanism which, in the illustrative embodiment, comprises a pair of positioning rods 84 which face operator's station assembly 12, the rods having a positioning hole extending therethrough for receiving a positioning pin.

Operator station assembly 12 comprises a base 86 having a post 88 attached, typically by welding, thereto and facing upright therefrom. Base 86 has a pair of hinge brackets 90, similar to brackets 80, attached thereto and spaced to receive bridge 16A therebetween with a hinge bolt 92 and nut 83. A pair of pipes 94 are secured to base 86 and sized to receive therein position rods 84 of the leg swing assembly 14. The positioning pipes 94 have holes extending therethrough which are alligned with the holes in the position rods 84 for receipt of a transport locking pin 26.

Post 88 has secured at the top thereof a handle 96 which may be welded to form a T-shaped projection in conjunction with post 88. In the illustrative embodiment, both handle 96 and post 88 may be hollow tubular steel, with handle 96 having end caps 98 secured at both ends thereof. An opening handle 48 is secured to post 88 to allow for ease of separating the operator station assembly 12 from the leg swing assembly 14. Base 86 also has attached thereto a pair of roller brackets 100 designed to receive and maintain in a journalled manner, a roller assembly comprising a roller shaft 102 carrying a pair of roller bearings 104 over which roller 46 is affixed. Roller 46 is intended to facilitate ease of moving the apparatus 10 when in the collapsed configuration, as illustrated in FIG. 2A. This configuration can be achieved by tilting the apparatus at an angle so that roller 46 is in contact with the surface on which the apparatus is to be transported.

Operator's station assembly 12 further comprises a foot pedal assembly, as illustrated collectively in FIGS. 3 and 4. Specifically, post 88 has secured thereto a pedal axle 106 on which pedal arm 30 is pivotally mounted using a collar 31 and a pair of bushings 33. The pedal arm 30 has at the free end thereof an extension 108 which is positioned at approximately a 65° angle to the axis of pedal arm 30 and has a hole extending therethrough. A stopper arm 105 is attached to post 88 and has a rubber stopper 107 affixed at the free end thereof to limit the movement of pedal arm 30. A pair of spring collars 108 are attached to the undersurface of pedal arm and post 88. An spring 115, which in the illustrative embodiment may be approximately 10 inches in length, is secured between collars 108. The end of pedal arm 30 not connected to cable 22 has a hole extending therethrough to receive a foot pedal 28. In addition, a pedal stop, in the form of a metal plate, may be attached to pedal arm 30 to prevent the end of the pedal assembly from being overextended upward once downward pressure is applied to pedal 28.

Referring to FIG. 3 again, bridge assembly 16 comprises a pair of substantially rectangular, three-sided steel tubes 16A and 16B. Bridge section 16A is secured to operator's station assembly 12 via hinge brackets 90 and hinge bolt 92. Bridge section 16B is attached to leg swing assembly 14 via hinge brackets 80 and hinge bolt 82. A bridge center hinge 112 is secured to the ends of bridge sections 16A and 16B which are not secured to a base. The center hinge 112 may be welded to sections 16A–B. A pair of hinge lock plates 114 are secured to the end of bridge section 116B at the end attached to hinge 112. A pair of complimentary mating holes extend through bridge section 16A so that when bridge 16 is fully extended, as illustrated in FIG. 1, the holes in section 16A align with the hinge lock plates 114 projecting from section 16B so that locking pin 26B may be inserted therethrough fixing the bridge 16 into an extended position. As illustrated in FIG. 1, a set of three locking pin 26A–C are attached to bridge 16 via chains 17 which may be secured to the respective sections of bridge 16. Locking pin 26A is aligned with and insertable into the positioning holes contained within hinge brackets 80 while locking pin 26C may be aligned with and insertable into the positioning holes contained within hinge brackets 90. When bridge 16 is in a fully extended position, locking pins 26A–C may be secured as previously described. Conversely, when bridge 16 is in a fully collapsed position, locking pin 26B may double as a transport locking pin and be inserted into the positioning hole extending through position rods 84 and positioning pipes 94, when properly aligned.

In an alternative embodiment, bridge sections 16A–B may be either rectangular or tubular in shape and of complimentary dimensions to allow for intercoupling in a telescoping manner. With such embodiment, rather that pivoting relative to assemblies 12 and 14, bridge sections 16A–B would slide relative to each other to so that their collective length increases or decreases the distance between assemblies 12 and 14. A locking pin may also be used to secure bridge sections 16A–B at one or more different length positions.

In still other alternative embodiments, bridge sections 16A–B may be replaced with a single section 16 that is either fixed to assemblies 12 and 14 or removably fixed thereto to allow for moving of the apparatus as separate assemblies.

A cable mount 116 secured, typically by welding, to the end cap of leg mount cylinder 68 is used to mechanically couple the leg mount assembly 54 to the cable 22. In the illustrative embodiment, cable 22 may be implemented with vinyl coated wire rope. Each end of cable 22 is secured to a cable and lock 118. In addition, a cable clip 120 couples the cable end lock 118 of cable 22 to the extension of pedal arm 30, as illustrated.

In the illustrative embodiment, leg 18 may be made of a semi-flexible material, such as molded rubber, which mimics the softness of a human leg and is able to transfer energy to the ball in a manner which mimics a human leg kicking the ball. The shape of leg 18, in an illustrative embodiment, mimics that of a human leg to add realism to the blocking exercise. It will be obvious to those reasonably skilled in the arts that other materials may be utilized for leg 18. The mechanism used to hold the ball in place may be implemented in a number of different ways including a substantially arcuate indentation in the surface of the leg 18 or a raised, cup-like projection 19 shaped to seat the ball at the end of leg 18. Alternatively, in place of, or in addition the above described configurations, mechanisms may be used to frictionally attach the ball to leg 18. Such devices may comprise a dense array of tiny hooks on leg 18 and a complimentary mating dense fabric pile on the ball, e.g. VELCRO™, that when pressed together frictionally retain the ball on leg 18. Alternatively, complimentary magnetic material on the ball and leg 18 may be utilized to temporarily retain the ball on leg 18.

To utilize the apparatus 10, the operator utilizes roller 46 to position the apparatus where desired, preferably on a level surface. The locking pin 26B is then removed from the bridge section 16A–B while the apparatus is in the collapsed position, as illustrated in FIG. 2A. Next, outward force on the opening handle 48 in the direction of the arrows shown in FIG. 2B will cause the apparatus to expand into a fully-extended configuration, as illustrated in FIG. 2B. Pins 26A–C may then be inserted into their respective positioning holes along bridge 16. If not already connected, the cable 22 may be connected to pedal arm 30 using the cable clip 120. Leg 18, if not already coupled to leg mount assembly 54 may be secured to leg mount cylinder 68. Note that the actual extent to which the leg bolt 38 extends into leg 18 may be set with the position of a nut carried by bolt 38. Finally, protective pad 20 may be secured to the leg swing posts 58.

The apparatus 10 is then ready for use. The operator places a ball onto the free end of leg 18 so that the ball rests within the indentation at the free end. Downward force on foot pedal 28 causes the pedal arm 30 to pivot relative to post 88 causing the cable 22 to be retracted toward the operator. This force is translated via cable 22 and pulley 52 to the leg mount assembly 54 causing leg 18 to pivot upward from its resting position and causing the ball to be launched from the indented end of leg 18.

Utilizing the apparatus 10 as described herein, an operator may use varying amount of force on the pedal 28 causing the ball to be kicked or punted with an amount of force and speed related to that delivered to the foot pedal. The apparatus of the present invention facilitates blocking practice of punts and kicks without substantial risk of injury to either the operator or the blocking players.

Having described herein illustrative embodiments of the present invention, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not by the particular features which have been shown and described, but shall be construed also to cover any obvious modifications and equivalents thereof.

What is claimed is:

1. An apparatus for launching a ball comprising:

(a) a rigid frame;

(b) an elongate first member movably mounted to the frame;

(c) the first member having a first end thereof adapted to seat a ball;

(d) a second member mounted to the frame;

(e) means for mechanically coupling the first member to the second member so that force is transferable from the second member to the first member; and (f) the first member pivotable relative to the frame upon receipt of force transferred to the first member from the second member so that a ball seated at the first end of the first member is launched.

2. The apparatus of claim 1 wherein the second member is pivotally mounted to the frame and further comprises:

(c1) a first end shaped to receive force applied to the second member.

3. The apparatus of claim 2 wherein the first member and second members each have a second end coupled to the means for mechanically coupling; and the means for mechanically coupling the first member to the second member comprises a cable.

4. The apparatus of claim 2 the apparatus further comprising:

(g) a resistive element coupled intermediate the frame and the second member to provide counter-resistive force to any force applied to the first end of the second member.

5. The apparatus of claim 1 wherein the first member has an exterior surface covered with a resilient material.

6. The apparatus of claim 1 wherein the first member comprises a resilient material.

7. The apparatus of claim 1 wherein the first member is shaped to mimic a human leg.

8. The apparatus of claim 1 wherein the first end of the first member comprises a concave indentation.

9. The apparatus of claim 1 wherein the first end of the first member comprises a cup-like projection.

10. The apparatus of claim 1 wherein the frame further comprises:

(a1) a first projection extending outward from the frame to which the first member is movably mounted; and (a2) a second projection extending outward from the frame to which the second member is movably mounted.

11. An apparatus for imitating kicking of a ball comprising:

(a) a rigid frame;

(b) a first projection extending outward from the frame;

(c) a first member movably mounted to the first projection;

(d) a mechanism at a first end of the first member to seat a ball;

(e) a second member mounted to the frame;

(f) means for mechanically coupling the first member and the second member; and (g) the first member pivotable relative to the first projection so that a ball retained in an indentation at the first end of the first member is launched upon receipt of force transferred to the first member from the second member.

12. The apparatus of claim 11 wherein the second member is pivotally mounted to the frame and further comprises:

(e1) a first end shaped to receive force applied to the second member.

13. The apparatus of claim 12 wherein the first member and second members each have a second end coupled to the means for mechanically coupling; and the means for mechanically coupling the first member to the second member comprises a cable.

14. The apparatus of claim 12 the apparatus further comprising:

(h) a resistive element coupled intermediate the frame and the second member to provide counter-resistive force to any force applied to the first end of the second member.

15. The apparatus of claim 11 wherein the first member has an exterior surface covered with a resilient material.

16. The apparatus of claim 11 wherein the first member comprises a resilient material.

17. The apparatus of claim 11 wherein the first member is shaped to mimic a human leg.

18. The apparatus of claim 11 wherein a raised cup is shaped to receive a ball.

19. The apparatus of claim 11 wherein the apparatus further comprises:

(h) a second projection extending outward from the frame, the second member movably mounted to the second projection.

20. An apparatus for launching a ball comprising:

(a) a rigid frame (b) a prosthetic leg movably mounted to the frame;

(c) the prosthetic leg including a mechanism to seat a ball at an end thereof;

(c) a pedal pivotally mounted to the frame;

(d) a cable coupling the prosthetic leg to the pedal so that force applied to the pedal is transferable to the prosthetic leg; and (e) the prosthetic leg pivotable relative to the frame so that a ball seated in an indentation of the prosthetic leg is launched upon receipt of force by the pedal.

21. The apparatus of claim 20 wherein the prosthetic leg comprises a resilient material.

22. The apparatus of claim 20 wherein the apparatus further comprises:

(f) a resistive element coupled intermediate the frame and the pedal to provide counter-force to any force applied to the pedal.

23. The apparatus of claim 20 wherein the frame further comprises:

(a1) a first frame member having a projection extending outward therefrom to which the prosthetic leg is pivotally mounted;

(a2) a second frame member having a projection extending outward therefrom to which the pedal is mounted; and (a3) a mechanism mechanically coupling the first frame member to the second frame member.

24. The apparatus of claim 23 wherein the mechanism mechanically coupling the first frame member to the second frame member comprises a collapsible-expandable linkage the may be fixed into one of an expanded and collapsed configuration.

25. A method for imitating the launching of a ball comprising:

(a) providing an apparatus having a frame with first and second members movably mounted to the frame, the first and second members mechanically coupled, the first member having a first end shaped to seat the ball;

(b) placing the ball into the first end of the first member; and (c) applying force to the second member so that the force is transferred to the first member causing the first member to pivot relative to the frame and further causing the ball to disengage the first member.

26. A method for facilitating controlled launching of a ball comprising:

(a) providing a rigid frame;

(b) movably mounting a first member to the frame, the first member having a first end shaped to receive a ball to be launched;

(b) movably mounting a second member to the frame;

(c) mechanically coupling the first member to the second member so that force can be transmitted from the second member to the first member causing the first member to pivot relative to the frame so that the ball received at the first end of the first member will be launched from the first member.

* * * * *